United States Patent [19]

Lovas et al.

[11] Patent Number: 4,644,742

[45] Date of Patent: Feb. 24, 1987

[54] PROCESS AND DEVICE FOR JOINING A THREAD IN AN OPEN-END SPINNING DEVICE

[75] Inventors: Kurt Lovas, Böhmfeld; Walter Mayer; Stephan Wittmann, both of Ingolstadt, all of Fed. Rep. of Germany

[73] Assignee: Schubert & Salzer, Ingolstadt, Fed. Rep. of Germany

[21] Appl. No.: 460,639

[22] Filed: Jan. 24, 1983

[30] Foreign Application Priority Data

Jan. 26, 1982 [DE] Fed. Rep. of Germany ..... 3202428

[51] Int. Cl.[4] ..... D01H 15/02

[52] U.S. Cl. ..... 57/263

[58] Field of Search ..... 57/261–263, 57/78, 81

[56] References Cited

U.S. PATENT DOCUMENTS 3,355,868 12/1967 Civrny et al. ..... 57/263 X
3,680,300 8/1972 Landwehrkamp ..... 57/263
3,695,017 10/1972 Hori et al. ..... 57/263
3,810,352 5/1974 Miyazaki et al. ..... 57/263
3,938,306 2/1976 Bous ..... 57/263
4,175,370 11/1979 Stahlecker ..... 57/263
4,327,546 5/1982 Derichs et al. ..... 57/263

*Primary Examiner*—John Petrakes
*Attorney, Agent, or Firm*—Dority & Manning

[57] ABSTRACT

When a thread is joined in an open-end spinning device, the thread is fed back into the open-end spinning device as a result of reverse rotation of a bobbin and a pair of auxiliary rollers. After the feedback has ended, the thread is released by the pair of auxiliary rollers and, until normal spinning draw-off is started, the thread is subjected to an auxiliary draw-off at a greater distance from the open-end spinning device than the normal spinning draw-off. This auxiliary draw-off can be carried out exclusively by means of the bobbin or also independently of it. An auxiliary draw-off device serves for generating this drawing force and is located at a greater distance from the open-end spinning device than the pair of draw-off rollers.

28 Claims, 4 Drawing Figures

FIG. 1
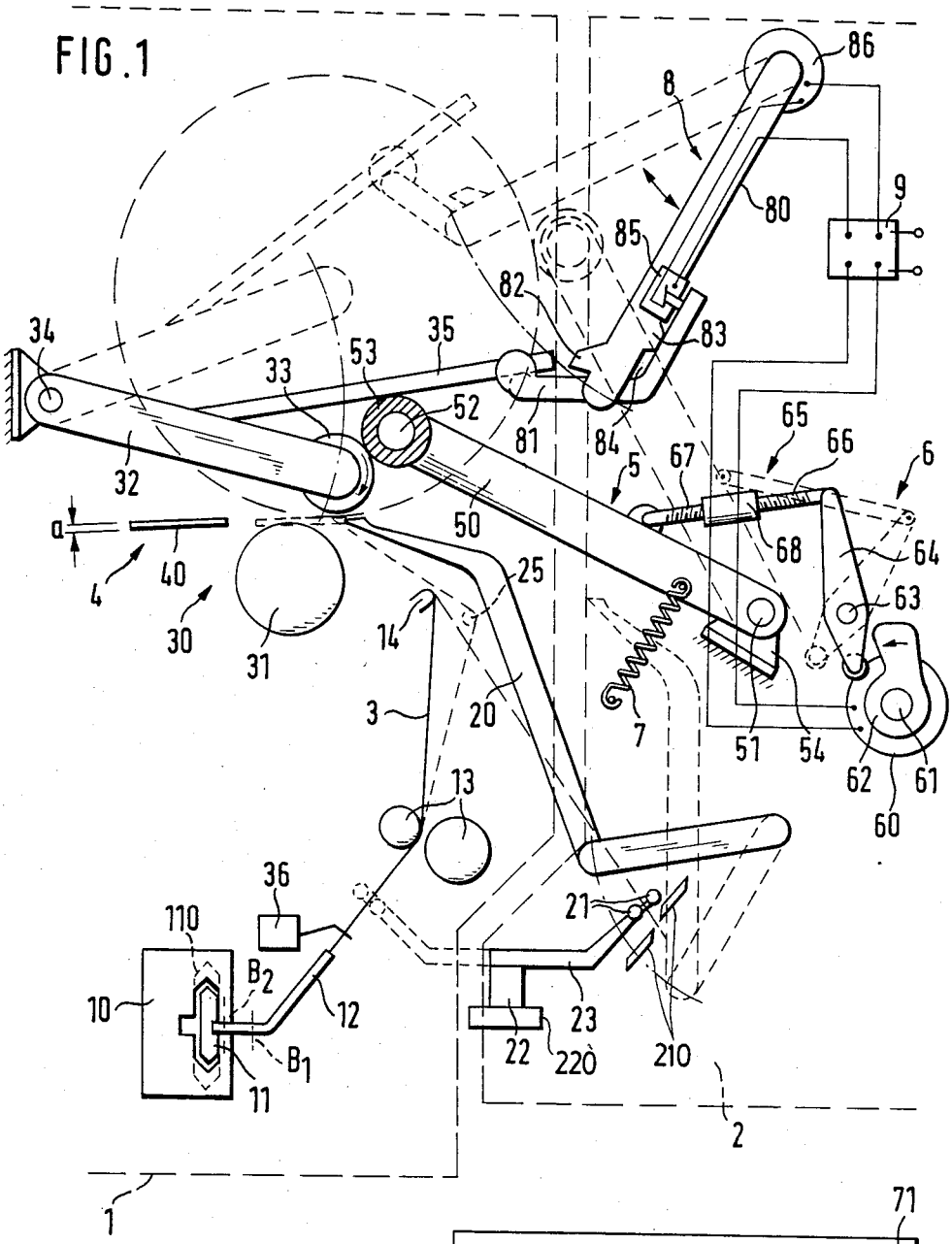
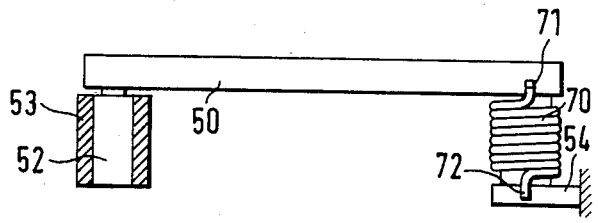
FIG. 2

PROCESS AND DEVICE FOR JOINING A THREAD IN AN OPEN-END SPINNING DEVICE

FIELD OF THE INVENTION

The present invention relates generally to a process for joining a thread in an open-end spinning device, in which the thread is fed back into the open-end spinning device. Specifically, the invention relates to a process as a result of reverse rotation of a bobbin and a pair of auxiliary rollers and is subsequently drawn off again from the open-end spinning device by means of a pair of draw-off rollers, and to a device for carrying out this process.

BACKGROUND OF THE INVENTION

It is known, from German OS 2,008,142 to join a thread by means of a device, to lift the bobbin off from the main drive roller and keep it separated from the roller and to feed the thread back to the spinning device, the fed back thread being received from the bobbin surface by means of a suction device and being supplied to a pair of draw-off rollers. On a pair of auxiliary rollers, the thread is brought to a specific length whereupon by means of further feedback a predetermined thread length is fed into the open-end spinning device. After the feedback has taken place, the thread is first drawn off from the open-end spinning device by means of the pair of auxiliary rollers, until, after a desired spooling speed has been reached, the thread is introduced into the pair of draw-off rollers.

In this known process, during the joining of a thread only a short period of time is available between the feedback of the thread into the spinning rotor and the start of the thread draw-off from the spinning rotor. When this period of time is exceeded, the thread is over-twisted, so that the thread breaks. On the other hand, in the short period of time for which the thread end can remain in the spinning rotor during the joining phase, twisting cannot continue sufficiently far into the fiber ring so that in the case of a thread draw-off which starts very suddenly, as occurs in the known device, there is likewise the danger of thread breaks.

it is also known to unwind the thread from the bobbin by hand and guide it back into the spinning rotor. Subsequently, the bobbin is re-engaged with its drive roller so that the thread is drawn off from the bobbin (German Offenlegungsschrift 1,560,336) until it is grasped by the traversing thread guide and brought into the region of a catching notch on the pressure roller of the pair of draw-off rollers which brings the thread into the clamping region of this pair of rollers. In this device, the thread is accelerated abruptly both during the start of winding and during grasping by the catching notch and this can lead to thread breaks. Moreover, it is not possible, in a known device, to achieve specific starting of the draw-off, since, in a known state of the art, the bobbin is supported on the drive mechanism and the varying mass of the bobbin causes, during the joining draw-off, a varying slip of the bobbin. Furthermore, tolerances in the shock-absorbers and load-compensating devices for the bobbin arms give rise to different joining ratios at the various spinning units of a machine, and this can make it more difficult to control the thread-joining operation.

An object of the invention is, therefore, to provide a process and a device which avoid these disadvantages and which guarantee specific starting of the thread draw-off during the joining operation even when there is a plurality of spinning units.

SUMMARY OF THE INVENTION

To achieve the foregoing object, it is envisaged, according to the invention, that after the feedback has ended the thread is released by the pair of auxiliary rollers, and until normal spinning draw-off has started, it undergoes an auxiliary draw-off which is at a greater distance from the open-end spinning device than said spinning draw-off. As a result of the release of the thread by the pair of auxiliary rollers, as soon as said pair has performed its function of feeding the thread back into the open-end spinning device, the twisting in the yarn, which takes place in the draw-off tube as a result of the rotation of the spinning rotor, can therefore be distributed over a relatively long length of thread so that too much twisted yarn does not enter the spinning rotor. Because of this, in comparison with the known process, during the joining operation more time is available, by means of the pair of auxiliary rollers, as retention time of the thread in the spinning rotor. This longer time available also allows smoother starting of the thread draw-off. Because the thread undergoes an auxiliary draw-off at a greater distance than in the normal spinning draw-off, an even longer length is available for receiving the twists. By means of these two measures, the number of thread breaks during joining is reduced and the tearing strength in the leader is substantially increased, since in this way a certain approximation of the thread draw-off running-up curve to the effective running-up curve of the fiber feed in the spinning rotor occurs.

According to an advantageous design, the auxiliary draw-off is carried out exclusively by means of the bobbin. In this way, the smoother starting of the thread draw-off can be brought about by means of a certain, but specific slip of the bobbin. This slip is advantageous also because, during joining, the fiber feed into the spinning rotor, or another open-end spinning element, also does not start abruptly, but progressively. After a short time which is sufficient for the bobbin to reach its full speed, the thread is transferred to the pair of draw-off rollers. Since at this moment the thread is already drawn off from the open-end spinning device at full speed, here too there are no jumps in speed, so that there is no danger of thread breaks even at this moment.

However, it is not absolutely essential for the joining draw-off to be carried out by means of the bobbin, but it is entirely possible, and in conjunction with further operations which are to be carried out in connection with joining, often extremely expedient if the auxiliary draw-off is carried out independently of the bobbin.

Appropriately, the auxiliary draw-off is maintained in a substantially constant ratio to the running-up curve of the fiber feed effective in the open-end spinning device. As a result, less fiber material is required in the open-end spinning device at the moment when the thread draw-off starts, so that the excessive quantity of fiber which otherwise results in a thicker place in the thread thickness, can be avoided in the open-end spinning unit, whilst at the same time, as a result of the progressive propagation of the twist into the open-end spinning device, the yarn strength does not decrease in comparison with the thread leaders produced hitherto in the conventional way.

To have even more time available for starting the joining draw-off, so that the even greater tolerances for this can be selected without impairing the joining reliability, it is envisaged that the feedback time be reduced to the minimum time. This is achieved according to the invention, due to the fact that, before the feedback of the thread, a thread reserve is formed via a throw-off member, and the thread end to be supplied to the open-end spinning device is brought to a specific length, that the feedback of the thread end by means of the pair of auxiliary rollers is carried out merely into a position of readiness within the open-end spinning device, and that after the thread has been released by the pair of auxiliary rollers, the joining feedback is carried out as a result of the throwing-off of the thread by the throw-off member. Not only does this ensure that the time tolerances for starting the joining draw-off become greater, but a substantial self-control of the joining operation is also obtained, since the introduction of a twist to the thread automatically matches the yarn diameters, its stretching properties, etc. This automatic matching of the joining operation to the yarn characteristics also means that greater time tolerances for the start of the joining draw-off can be selected.

If the spinning member, for example the spinning rotor, is exchangeable, so that collecting surfaces of different diameters are used, it is necessary to adjust the feedback distance to this. To obtain constant joining ratios here, the actual joining feedback will always proceed under constant conditions. Consequently, according to the invention, matching to the different diameters does not take place by means of the throw-off member, but by means of the pair of auxiliary rollers. According to a further feature of the invention, this arises because the position of readiness within the open-end spinning device is selected so that irrespective of the particular diameter of the spinning member selected the distance of the joining feedback as a result of the throwing-off of the thread is always of the same amount.

Starting from a device for joining a thread in an open-end spinning device, with a pair of auxiliary rollers for receiving, feeding back and releasing the thread on the open-end spinning device, with a pair of draw-off rollers for drawing off the thread during the normal spinning operation, to carry out the process mentioned there is, according to the invention, an auxiliary draw-off device which is located at a greater distance from the open-end spinning device than the pair of draw-off rollers. By means of this auxiliary draw-off device, the joining draw-off can be carried out in a desired way. Since the auxiliary draw-off device is located at a greater distance from the open-end spinning device than the pair of draw-off rollers, the twist arising in the joining phase can be distributed over a greater length of the thread, so that the danger of overtwisting of the joining thread end in the spinning rotor is reduced. This makes it possible to work at substantially higher rotor speeds in comparison with conventional joining processes. This means that it is not necessary, as a rule, to keep the spinning rotor at a low speed for the joining operation or to monitor its speed, but instead it is possible to carry out joining at the high production rotor speeds conventional today.

In a spooling mechanism which has bobbin arms for receiving a bobbin, with a main drive roller for driving the bobbin and with a mechanism for lifting the bobbin off from the main drive roller and for driving the bobbin, this mechanism having a pivoting arm and a roller which can be driven in both directions, as well as a controllable pivoting drive for the pivoting arm which works against the effect of an elastic element, according to the invention the auxiliary draw-off device can be formed by the spooling mechanism, the mechanism for lifting off and driving the bobbin consisting of a bobbin-lifting mechanism for forming a specific distance between the bobbin and the main drive roller and of an auxiliary bobbin drive which can be brought into action, as a result of the effect of the elastic element, on the side of the bobbin facing away from the main drive roller.

By means of the bobbin-lifting mechanism, the bobbin is lifted off from the main drive roller immediately when a thread break arises. This can occur so quickly that the end of the broken thread no longer reaches the bobbin at all and hangs down freely from the bobbin. It is therefore especially simple for the thread to be received for the feedback. However, even when the thread passes onto the bobbin, it can easily be received here during the subsequent reverse rotation of the bobbin, since the rapid stopping of the bobbin prevents the thread from being rolled firmly into the bobbin. The bobbin-lifting mechanism is designed so that a specific distance is formed between the bobbin and the main drive roller, so that the instantaneous radius of the bobbin has an effect on the working position of the auxiliary bobbin drive which interacts with the side of the bobbin facing away from the main drive roller. In this way, different positions of the pivoting arm of the auxiliary bobbin drive, depending on the size of the bobbin, are obtained during the driving of the bobbin. The pivoting drive is designed so that it causes the roller to be lifted off from the bobbin, whilst when the pivoting arm is released by the pivoting drive the elastic element causes the roller to bear against the bobbin. Since the bearing position of the roller against the bobbin is different depending on the bobbin radius, the elastic element possesses a varying pre-stress during the working of the roller, so that the roller also rests against the bobbin with varying force. By a suitable choice of the characteristics of the elastic element, for example when the elastic element is designed as a spring, by an appropriate choice of the spring constants, dimensions and pre-stressing, it is possible to ensure that a slip which normally varies as regards bobbins of different sizes is avoided, so that essentially always the same slip and therefore always the same joining ratios are achieved irrespective of the bobbin diameter.

To obtain a greater working range for the roller, it is envisaged advantageously that the bobbin-lifting mechanism be designed so that it forms a specific distance between the peripheral faces of the bobbin and the main drive roller. In this way, the full bobbin diameter takes effect on the pre-stressing of the elastic element and this makes it substantially easier to compensate for the varying bobbin mass by means of different pressing forces of the roller.

The specific distance between the peripheral faces of the bobbin and the main drive roller can be obtained in various ways. Appropriately, the bobbin-lifting mechanism has a lifting element interacting with the side of the bobbin facing the main drive roller, and assigned to the bobbin-lifting mechanism is a support mechanism interacting with a bobbin arm and securing the specific distance between the peripheral faces of the bobbin and the main drive roller. Since the lifting element of the bobbin-lifting mechanism interacts with the side of the bobbin facing the main drive roller, the specific distance between the peripheral faces of the bobbin and the main drive roller can thereby be obtained in an especially simple way. Monitoring devices for checking this distance, such as, for example, light barriers susceptible to fly, are therefore not necessary. So that the bobbin can be rotated for joining purposes, according to the invention there is the support mechanism which interacts with a bobbin arm and which guarantees the specific distance between the peripheral faces of the bobbin and the main drive roller even when the lifting element releases the bobbin again.

It is especially advantageous in an open-end spinning machine with a plurality of open-end spinning devices if only the bobbin-lifting mechanism is arranged to be stationary in each spinning unit, but the support mechanism and the auxiliary bobbin drive are located on a service mechanism movable along the open-end spinning devices. In this way, a less expensive spooling device suitable for the joining operation according to the invention can be provided.

To avoid the need for contactless monitoring devices to monitor the position of the support mechanism for the bobbin, since these are susceptible to faults because of fly which possible occurs, it is preferably envisaged that the support device have a drive lever pivotable by means of a controllable drive, and a supporting lever which is located on this drive lever and is pivotable between two end positions and which is stressed in the direction of the bobbin by an elastic element and can thereby be brought into its first end position and, when it contacts one of the two bobbin arms, into its second end position to which is assigned a switching device for ending the pivoting movement of the drive lever. The switching device is actuated mechanically in this way. Moreover, it is ensured by means of the above-mentioned device according to the invention that despite the different positions of the bobbin arms these are always supported by the support mechanism in such a way that the specific distance between the peripheral faces of the bobbin and the main drive roller is guaranteed, so that the lifting element can be retracted and the support function left to the support mechanism. According to a preferred design of the subject of the invention, the controllable drive for the drive lever is designed as an electric motor and the switching device is designed as an electrical switch which is located on the drive lever and which, when actuated by the supporting lever, interrupts the supply of current to the motor. Appropriately, the end positions of the supporting lever are fixed by two stops attached to the drive lever.

The elastic element assigned to the pivoting arm can have various designs, but to achieve a compact design of the auxiliary bobbin drive it is preferred, according to the invention, that the elastic element assigned to the pivoting arm be designed as a torsion spring.

So that various elements working during the joining operation can be controlled from one and the same drive, it is envisaged, according to a further feature of the invention, that the pivoting drive for the pivoting arm have a rotatable cam disk and an adjustable intermediate linkage between the cam disk and the pivoting arm. This intermediate linkage makes it possible to adjust the pivoting arm in an especially simple way.

To prevent severe indentation of the roller of the auxiliary bobbin drive into the bobbin even in the case of a relatively large bobbin diameter, it can also be envisaged, according to the invention, that the roller carry a cover consisting of a soft material, preferably soft rubber.

Leaders of good quality are obtained by means of the device according to the invention. Nevertheless, it can be advantageous for many purposes to provide a knot or another thread connection instead of the leader. It is advantageous for this purpose to draw off the thread from the open-end spinning device independently of the bobbin. For this purpose, it is envisaged, according to a further feature of the invention, that the auxiliary draw-off device be formed by a second pair of auxiliary draw-off rollers, which can be brought into action on the side of the pair of draw-off rollers which faces away from the open-end spinning device. Even if it is also possible, in principle, to use in general such a pair of auxiliary draw-off rollers for carrying out the joining draw-off, a pair such as this is, as mentioned, especially advantageous in conjunction with a thread connection device replacing the leader, and for this reason, in a further design of the subject of the invention, a thread connection device can be brought into the thread run between the pair of draw-off rollers and the second pair of auxiliary draw-off rollers.

So that the time tolerances available for starting the joining draw-off can be increased further, the feedback takes place in two steps. For this purpose, a thread-cutting device and a feedback-measuring device are assigned, according to the invention, to the pair of auxiliary rollers, whilst a thread throw-off member deflecting the thread is located between the pair of draw-off rollers and the bobbin. The function of the thread-cutting device and the feedback-measuring device is to bring the thread to a specific length and into a predetermined position of readiness, whilst the throw-off member allows the thread to come into contact with the fibers supplied to the open-end spinning device. To provide always constant joining feedbacks by means of the throw-off member and therefore also constant joining conditions, even when the spinning member is exchangeable for one with a different diameter of the fiber collecting surface, it is envisaged, according to a further feature of the invention, that the feedback measuring device be adjustable as a function of the particular diameter of the spinning member selected.

The subject of the application provides the preconditions for being able to join a thread reliably even at high rotor speeds, so that exact co-ordination of the attachment operation in time with the running-up curve of the spinning rotor is not necessary. This results in substantial simplification of the control which allows large time tolerances and which can therefore be mastered easily.

DESCRIPTION OF THE DRAWINGS

Further advantages and details of the invention are explained with reference to the following description and an exemplary embodiment illustrated in the drawings in which:

FIG. 1 shows the subject of the invention in a diagrammatic side view;

FIG. 2 shows a plan view of a modification of the detail of the device illustrated in FIG. 1; and, FIGS. 3 and 4 show, in diagrammatic side views, a further modification of the subject of the invention in two different working stages.

DETAILED DESCRIPTION OF A PREFERRED EMBODIMENT

Figure 3:
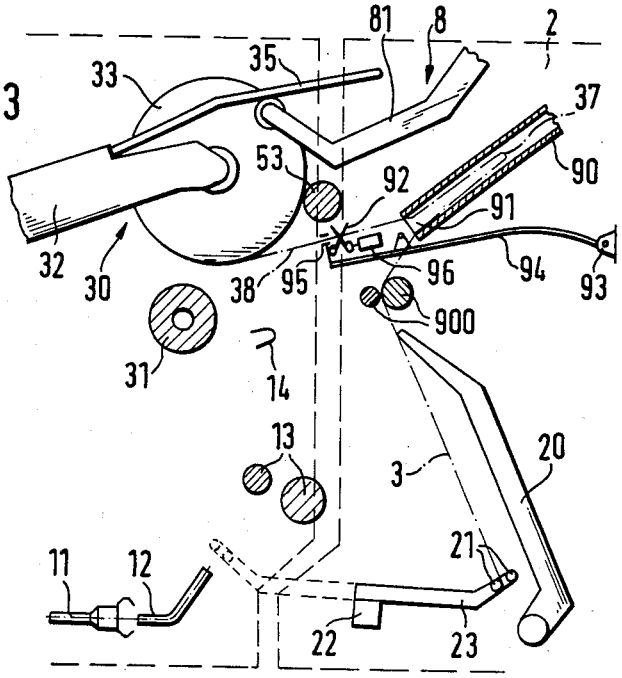

The device and the process will be explained first with reference to FIG. 1. In this illustration, the essential parts of a spinning machine 1 working according to the open-end spinning process are reproduced, inasmuch as they are necessary for understanding the explanation. In practice, these parts are, as a rule, distributed on the spinning machine 1 and on a service device 2 movable along the spinning machine 1, although it is also possible to provide all the elements shown on the spinning machine 1 itself and to do away with the service device 2, especially on test machines with one or only a few spinning units.

The spinning machine 1 illustrated has a plurality of spinning units, although FIG. 1 shows only one of these. For each spinning unit there is an open-end spinning device with a spinning element located in a means for receiving same, such as a housing 10, a pair of draw-off rollers 13 and a spooling device 30. In the embodiment shown, for example, spinning rotor 11 serves as a spinning element which produces a thread 3 which, after fibers supplied in a conventional way to the spinning element by means of a fiber feed device and a loosening device, for example in the form of a loosening roller, have been tied in, is drawn off from the housing 10 through a draw-off tube 12 by means of the pair of draw-off rollers 13. A thread monitor 36 is located in the thread run between the housing 10 and the pair of draw-off rollers 13.

To wind the thread 3, the spinning machine 1 has a spooling device 30 which comprises essentially a main drive roller 31 for driving the bobbin 33 which can be exchangably received by two pivotable bobbin arms 32. The bobbin arms 32 are pivotable about a pivot pin 34.

To compensate for the thread tension which fluctuates during the traversing of the thread 3, a thread-tension compensating bracket 14 is located in a known way in the thread run between the pair of draw-off rollers 13 and the bobbin 33.

Furthermore, there is on the spinning machine 1, for each spinning unit, a lifting element 40 which forms part of a bobbin-lifting mechanism 4 and which, by being pushed in between the main drive roller 31 and the bobbin 33, lifts the latter off from the main drive roller 31 by specific value "a", so that a distance "a" defined by the thickness of the lifting element 4 is formed between the peripheral faces of the bobbin 33 and the main drive roller 31.

Located on the service device 2 is a suction tube 20 which can be brought against the underside of the bobbin 33 lifted off from the main drive roller 31, so that there it can receive the end of a torn thread 3. The suction tube 20 has a bent shape and possesses a longitudinal slit (not shown) on its side facing the spinning machine 1, so that the thread 3, as it penetrates increasingly into the suction tube 20, can partially leave this slit again in the form of chord.

The service device 2 also carries a pair of auxiliary rollers 21 which is carried by a lever 23 pivotable about a pivot pin 22, so that the pair of auxiliary rollers 21 can grasp the thread 3 arranged in the manner of a chord in relation to the suction tube 20 and supply it to the draw-off tube 12.

Moreover, an auxiliary bobbin drive 5 is located on the service device 2. The auxiliary bobbin drive 5 possesses a pivoting arm 50 which is mounted pivotably on a pivot pin 51 and which carries at its free end a roller 52 which can be driven, in a way not shown, from a drive (not shown) selectively in one direction or the other. The roller 52 is surrounded by a cover 53 consisting of soft rubber or another soft material.

Also located on the service device 2 is a pivoting drive 6 for the pivoting arm 50, which has, in the design illustrated, a cam shaft 61 which is driven by a motor 60 and on which a cam disk 62 is located. Mounted pivotably on a pivot pin 63 carried by the service device 2 is a two-armed lever 64 one end of which the cam disk 62 can engage and to the other end of which an actuator 65 is connected. This actuator 65, the free end of which is connected to the pivoting arm 50, consists, in the design illustrated, of two bolts 66 and 67 which have opposing threads and on which is screwed a threaded sleeve 68 with opposing threads, so that the distance between the lever 64 and the pivoting arm 50 can be changed as a result of rotation of the threaded sleeve 68. Exact adjustment of the lever 64 in relation to the pivoting arm 50 is possible in this way. In the appropriate position, the cam disk 62 causes the roller 52 to be lifted off from the bobbin 33, whilst a tension spring 7 engaging on the pivoting arm 50 ensures that when the lever 64 is released by the cam disk 62, the pivoting arm 50 is supported against the bobbin 33.

Attached to the bobbin arm 32 is an additional arm 35 with which a support mechanism 8 can interact. In the design illustrated, the support mechanism 8 consists essentially of a pivotably mounted drive lever 80 on the free end of which a supporting lever 81 is articulated. This two-armed supporting lever 81 is movable between two stops 82 and 83 attached to the drive lever 80 and is stressed by means of an elastic element, which is designed as a compression spring 84 and which is supported by one end on the drive lever 80 and by its other end on the supporting lever 81, in such a way that the supporting lever 81 is normally supported on the stop 82. A switch 85 is provided on the drive lever 80, so that the supporting lever 81, when it rests against the stop 83, actuates this switch 85, without being supported on the switch housing. The switch 85 is connected electrically to a motor 86 which serves as a pivoting drive for the drive lever 80 and which, when stopped, secures the drive lever 80 in its present position. The motor 86 is connected to a control device 9 which is also connected to the motor 60.

The device, the construction of which was described above, works as follows:

When a thread break occurs, this triggers via the thread monitor 36 the ending of the fiber feed into the spinning rotor 11 and lifting the bobbin 33 off from the main drive roller 31, because the lifting element 40 forming the essential component of the bobbin-lifting mechanism 4 is pushed between the bobbin 33 and the main drive roller 31. The winding of the thread 3 onto the bobbin 33 is thus interrupted extremely quickly, depending on the winding speed often even before the thread end has reached the bobbin 33. Because the lifting element 40 is pushed in between the main drive roller 31 and the bobbin 33, the bobbin-lifting mechanism 4 forms a precisely defined distance "a" between the peripheral faces of the bobbin 33 and the main drive roller 31, this distance corresponding to the thickness of the lifting element 40 between the bobbin 33 and the main drive roller 31.

By means of the loosening roller (not shown) which continues to run even after the fiber feed device has stopped, the fiber tuft projecting into the working range of the loosening roller is trimmed off and supplied to the spinning rotor 11 together with the fibers located in the lining of the loosening roller.

Said thread monitor 36 triggers, in a known way, a signal which either calls up the service device 2 or ensures that the continuously revolving service device 2 stops at the faulty spinning unit so as to eliminate the thread break.

When the service device has assumed its working position at the relevant spinning unit, a rotor-cleaning device (not shown) is switched on temporarily from the control device 9, with the result that the fibers located in the spinning rotor 11 are removed from this in a way known per se. Furthermore, the pressure roller of the pair of draw-off rollers 13 is lifted off from the driven roller, in a way not shown, from the service device 2. Moreover, the drive lever 80 together with the supporting lever 81 is pivoted upwards by means of the motor 86. During this movement, the supporting lever 81 resting against the stop 82 comes to rest against the arm 35 of the bobbin arm 32. As a result, the supporting lever 81 is pivoted in relation to the drive lever 80 counter to the effect of the compression spring 84, until it comes up against the stop 83. In this position, the supporting lever 81 actuates the switch 85 which is thereby opened and thus interrupts the supply of current to the motor 86. The lifting movement of the drive lever 80 is consequently terminated, and this lever is fixed in the present position. The control device 9 now ensures that the lifting element 40 is retracted, so that the latter releases the bobbin 33. This can be effected from the service device 2 by means of mechanical action on the lifting element 40 or as a result of actuation of an electrical element (not shown) which causes this retraction. However, in spite of the retraction of the lifting element 40, the bobbin 33 remains in its present position, since it is supported by the supporting lever 81.

After the bobbin 33 has been released by the lifting element 40, the control device 9 ensures, in a way not shown, that the suction tube 20 is brought into the thread-receiving position. In this position, the suction tube 20 is located on the underside of the bobbin 33, so that the distance between the suction tube 20 and the bobbin 33 is essentially always the same irrespective of the bobbin diameter. Moreover, the control device 9 switches on the motor 60 which causes the cam shaft 61 to rotate. In this way, the cam disk 62 releases the lever 64, so that as a result of the action of the tension spring 7 on the pivoting arm 50, the roller 52 is brought up against the bobbin 33. During this time, the tension spring 7 is tensioned to a greater or lesser extent depending on the size of the bobbin 33, so that in the case of a relatively large bobbin diameter the pressing force of the roller 52 on the bobbin 33 is greater than when the bobbin diameter is relatively small. Consequently, when the roller 52 is now driven, via drive means not shown, for the feedback of the thread 3, this varying pressing force causes compensation of the mass inertia and prevents a varying slip which otherwise occurs because of the different masses of the bobbin 33.

During the reverse rotation of the bobbin 33, the thread 3, which rests only loosely on the bobbin periphery as a result of the rapid stopping of the bobbin 33 by means of the lifting element 40, is sucked into the suction tube 20, and during suction, because of the bent shape of the suction tube 20, it partially leaves the suction tube 20 again in the form of a chord. After a sufficient thread length has passed into the suction tube 20 as a result of control from the control device 9 the feedback of the thread 3 is interrupted and the suction tube 20 is brought into its position shown by broken lines. Subsequently, the pair of auxiliary rollers 21 is pivoted by conventional means such as a motor (not shown) out of a position of rest about the pivot pin 22, this pair of auxiliary rollers 21 clamping the run of the thread 3 entering the slit in the suction tube 20. By conventional means not shown, the thread is severed on the side of the pair of auxiliary rollers 21 which faces away from the bobbin 33, and the pair of auxiliary rollers is pivoted to front of the mouth of the draw-off tube 12. In the meantime, the spinning rotor 11 or another open-end spinning element has been made to rotate again, and the fiber feed to the fiber collecting surface has been switched on again. Suitably co-ordinated in time with this, the thread 3 is fed back again as a result of rotation of the bobbin 33 and the pair of auxiliary rollers 21, until it reaches the fiber collecting surface of the spinning rotor 11 or of another open-end spinning element, whereupon the clamping of the pair of auxiliary rollers 21 is cancelled, for example as a result of lifting off the roller located further from the pivot pin 22 from the roller located nearer to the pivot pin 22. The thread 3 is thereby released by the pair of auxiliary rollers 21. The pair of auxiliary rollers 21 now returns to its position of rest. After the thread 3 has been released by the pair of auxiliary rollers 21, the roller 52 is driven in the opposite direction, so that the thread 3 is drawn off from the spinning rotor 11. In this joining phase, the thread 3 is therefore drawn off from the spinning rotor 11 exclusively by means of the bobbin 33.

As described, the drive of the fiber feed device is switched on at a moment synchronized with the feedback and renewed drawing-off of the thread 3. Since the previously emptied lining of the loosening roller must first fill up again, until the full fiber flow can pass into the spinning rotor 11, the fiber feed takes effect smoothly as regards the spinning rotor 11. In a manner corresponding to this taking effect of the fiber feed, the thread draw-off will also take effect "smoothly", so as to guarantee a leader of high strength and, on the other hand, to prevent an excessively large jump in the thread tension and consequently thread breaks. The roller 52 is therefore accelerated to the normal spooling speed in a relation synchronized with the taking effect of the fiber feed in the spinning rotor 11, and the unavoidable slip of the bobbin 33 is taken into account in the acceleration of the roller 52. As mentioned, the slip is maintained, irrespective of the particular bobbin diameter, by the choice of an appropriate spring constant, length and tension of the tension spring 7, in such a way that it has no falsifying effect, or a falsifying effect only within permissible limits, on the thread draw-off speed. When the bobbin 33 has reached the full spooling speed, the bobbin 33 is lowered onto the main drive roller 31 as a result of the pivoting of the drive lever 80, and because of the action of the cam disk 62 on the lever 64, the roller 52 is lifted off from the bobbin 33. Furthermore, the pressure roller of the pair of draw-off rollers 13 is released by the service device 2. Consequently, if the thread monitor 36 does not indicate any failure to eliminate the thread break, the thread draw-off and the winding of the thread 3 onto the bobbin 33 take place again, independently of the service device 2, by means of the spinning machine 1 itself. Elimination of the thread break, all the working steps of which are controlled by the control device 9 of the service device 2, is thus concluded.

The process described is not restricted to the exemplary embodiment illustrated. The device also can undergo modifications within the scope of technical equivalents or other combinations of features.

As mentioned, assigned in a conventional way to the pair of auxiliary rollers 21 is a thread-cutting device 210 which brings the thread 3 to a specific length. Moreover, assigned in a known way to the pair of auxiliary rollers 21 is a feedback-measuring device 220 which determines the number of rotations of the pair of auxiliary rollers 21 and consequently the feedback amount of the thread 3.

As shown by broken lines in FIG. 1, a throw-off member 25 deflecting the thread 3 can be provided in the thread run between the pair of draw-off rollers 13 and the bobbin 33. When the thread 3 is sucked off from the bobbin 33, the thread 3 passes onto the throw-off member 25. When the thread 3, after being cut to a predetermined length, is subsequently presented and supplied to the draw-off tube 12 by means of the pair of auxiliary rollers 21, the thread 3 assumes a curved path. By means of the feedback-measuring device mentioned, which is designed, for example, as a timer which controls the duration of the supply of current to the drive motor of the pair of auxiliary rollers 21, the pair of auxiliary rollers 21 is driven a predetermined number of revolutions in the feedback direction. As a result, the thread end reaches in the thread draw-off tube 12 a precisely defined position which is characterized in FIG. 1 as position $B_1$. In this position $B_1$, the thread end is located between the two ends of the thread draw-off tube 12, where it is retained securely by means of the vacuum acting in the spinning device. This position $B_1$ is selected so that the clearance of the thread end along the thread draw-off path is essentially equal to the additional thread distance which results from the deflection by the draw-off member 25 in comparison with the normal thread run between the pair of draw-off rollers 13 and the bobbin 33.

The pair of auxiliary rollers 21 now releases the thread 3 and can therefore be pivoted away from the region of the mouth of the draw-off tube 12. For joining the thread, the throw-off member 25 now throws off the thread 3, the end of which passes out of the position of readiness $B_1$ into the region of the fiber collecting surface of the spinning rotor 11 chosen as an example, where it ties in the fibers which have been fed in in the meantime. U.S. Pat. No. 3,680,300 shows a conventional way in which a throw-off member can throw off a thread. Synchronously in time with the thread throw-off by the throw-off member 25, the joining draw-off by means of the bobbin 33 now starts.

As mentioned, the released thread length has essentially the same length as the distance between the position of readiness $B_1$ along the thread draw-off path and the collecting surface, that it to say, the collecting groove of the spinning rotor 11; however, it must be remembered, in the thread reserve thrown off, that it must be possible for the thread end to be deposited in the collecting groove of the spinning rotor for the purpose of breaking open and tying in the fiber ring over a certain length of the periphery. As a result of the release of the thread 3 both by the pair of auxiliary rollers 21 and by the throw-off member 25, the thread 3 is fed back into the spinning rotor 11 solely by means of the vacuum acting in the open-end spinning device. Depending on the properties of the thread 3, this feedback takes place at different speeds, and it has been shown that threads which can receive a greater twist before being twisted off in the spinning rotor 11 follow this vacuum more quickly than threads which are more inelastic and therefore tend more to overtwisting and twisting off. This results in a certain automatic matching of the thread-joining operation to the yarn properties, thus increasing the thread-joining reliability.

In open-end spinning machines, in which spinning elements with different diameters of their collecting surfaces can be used, it is envisioned that the feedback measuring device can be adjusted as a function of the particular diameter selected. If, for example, the feedback measuring device is designed as a digitally adjustable timing relay, it is sufficient, according to the diameter selected, to preset the corresponding time as a digital value with the result that the working time of the drive motor for the pair of auxiliary rollers 21 and consequently also the feedback distance of the thread 3 are determined.

FIG. 1 shows by broken lines a spinning rotor 110 which has a larger diameter in comparison with the spinning rotor 11. So that the same thread-joining feedback path obtained by means of the throw-off member 25 can always be provided, irrespective of this diameter, the timing relay is adjusted to a higher time matching the larger rotor diameter, so that the pair of auxiliary rollers 21 delivers the thread 3 into the position of readiness $B_2$. Here too, the actual thread-joining feedback again takes place by means of the throw-off member 25 described.

Although it is not necessary, in principle, for the throw-off member 25 to move into its working position even before the feedback of the thread 3 by the pair of auxiliary rollers 21, nevertheless this saves a feedback from the bobbin 33, which is synchronized with the build-up of the thread reserve by the throw-off member 25 and which is necessary when the throw-off member 25 builds up the reserve length only at a later time.

As described above, it is essential for the process that during the joining phase the twist can temporarily be propagated, from the thread portion in which the twist arises, further than during the normal spinning operation into the part of the thread 3 facing away from the spinning rotor 11. For this purpose, it is necessary to keep the forces, which could cause a stop in the twist, lower on the side of the above-mentioned thread portion facing the bobbin 33 than on the side of this thread portion facing the spinning rotor 11, and, as far as is possible in terms of construction, to shift these forces in relation to the bobbin 33. This can be carried out by eliminating or at least weakening the deflection points for the thread 3, during the joining phase, so that they do not form a twist stop. This can be effected, for example, in such a way that the pair of draw-off rollers 13 or its driven roller is pivoted away from the thread run during the joining operation. When the thread clamping is cancelled as a result of the pressure roller being lifted off from the driven roller of the pair of draw-off rollers 13, the twist in the direction towards the bobbin can be propagated virtually unimpeded, whereas the propagation of the twist into the spinning rotor 11 is hampered by the deflecting edge at the mouth of the draw-off tube 12 facing the spinning rotor 11.

In the design described previously, the auxiliary draw-off for the joining operation takes place exclusively by means of the individual driving of the bobbin 33, but it is also possible to carry out this auxiliary draw-off independently of the bobbin 33. Thus, for example, an additional pair of auxiliary draw-off rollers 900 in the vicinity of the bobbin 33 can be brought into the thread run from the service device 2 for the joining draw-off. However, it is especially advantageous to draw-off the thread 3 exclusively by means of the bobbin 33 in the joining phase, since in this way no additional elements are required for the joining draw-off, but an appropriate choice of the elastic element designed, for example, as a tension spring 7 is sufficient for this purpose.

A modification of this type with a pair of auxiliary draw-off rollers 900 is described below with reference to FIGS. 3 and 4. Since such a design is appropriate especially when it is used in conjunction with a thread connection device 97 (for example, a knotter, a splicing device, etc.), by means of which the thread connection (leader) produced during the joining operation is replaced by another type of thread connection, this modification is described in relation to such a thread connection device 97.

The pair of auxiliary draw-off rollers 900, which is provided on the side of the pair of draw-off rollers 13 facing away from the spinning rotor 11, is located, in the exemplary embodiment illustrated, in the same way as the various elements described below, on the service device 2 and can, if required, be brought into its working position. The thread 3 is inserted into the pair of auxiliary draw-off rollers, when the latter is located in the vicinity of the run of the thread sucked into the suction tube 20, with the aid of means not shown and conventional for such purposes. On the side of the pair of auxiliary draw-off rollers 900 facing away from the spinning rotor 11, the mouth 91 of a thread suction device 90 can be brought into the thread run, so that when the tension in the thread portion between the pair of auxiliary draw-off rollers 900 and the bobbin 33 slackens it can receive the excess thread. Assigned to the mouth 91 of this thread suction device 90 is a cutting device 92 which can be controlled in a suitable way. In the design illustrated, the cutting device 92 is arranged on an arm 94 pivotable about a pivot pin 93, but it is also possible to fasten this device to the thread suction device 90 in front of the mouth 91. Also located on the side of the cutting device 92 facing away from the mouth 91 is a thread clamp 95 which, in the design illustrated, is actuated together with the cutting device 92 by means of an electromagnet 96.

The thread connection device 97 already mentioned and designed, for example, as a knotter is located in the thread run between the pair of draw-off rollers 13 and the pair of auxiliary draw-off rollers 900. A thread storage device 98 is located between the pair of draw-off rollers 13 and the thread connection device 97. Furthermore, between the thread connection device 97 and the pair of auxiliary draw-off rollers 900 there is a deflecting member 99 which maintains the thread extending to the bobbin 33, together with a suction nozzle 24, on a precisely defined thread run. This suction nozzle 24 can be brought out of a thread-receiving position, in which it receives the thread portion extending from the bobbin 33 to the thread clamp 95, into the position shown in FIG. 4.

The device illustrated in FIGS. 3 and 4 works as follows:

When a thread break occurs, the respective open-end spinning device is stopped and the service device 2 brought into the thread-joining position in the way explained with reference to the example of FIG. 1. The preparation and suction of the thread 3 into the suction tube 20 also take place in the way described. When a sufficient thread length has been sucked into the suction tube 20, thus guaranteeing that the thread 3 is retained securely by the suction tube 20, the thread 3 is inserted by conventional means (not shown) into the clamping line of the pair of auxiliary draw-off rollers 900 located in the vicinity of the thread run. The thread which continues to be unwound as a result of the reverse rotation of the bobbin 33 is now received by the mouth 91 of the thread suction device 90, located in the vicinity of the thread run between the bobbin 33 and the pair of auxiliary draw-off rollers 900, and is sucked in in the form of a loop 37. When a thread length sufficient for joining has been sucked into the suction device 90, the bobbin 33 is stopped and the thread 38 is severed between the bobbin 33 and the mouth 91 by means of the cutting device 92 and is retained firmly by the thread clamp 95.

The suction nozzle 24 is now brought into the region of the thread run between the bobbin 33 and the thread clamp 95. The reverse rotation of the bobbin 33 is continued. The thread clamp 95 releases the thread 38 which is now received by the suction nozzle 24. When the thread length received by the suction nozzle 24 guarantees secure retention of the thread 38 even during the pivoting of the suction nozzle 24, the latter is brought into a position shortly after the pair of draw-off rollers 13, seen in the direction of the thread draw-off from the thread draw-off tube 12. The thread-deflecting member 99 is then pivoted into the run of the thread between the bobbin 33 and the suction nozzle 24, with the result that the thread 38 is deflected.

Independently of this, the thread 3 extending from the thread suction device 90 to the suction tube 20 and inserted into the pair of auxiliary draw-off rollers 900 is received by the pair of auxiliary rollers 21, brought to the length required for joining and supplied to the suction tube 12. The pair of auxiliary rollers 21 and the pair of auxiliary draw-off rollers 900 are now rotated back simultaneously and synchronously, so that the thread 3 is fed back into the spinning rotor 11. The clamping of the pair of auxiliary rollers 21 is then cancelled, whereupon this pair of auxiliary rollers 21 can return to its initial position. However, the clamping of the pair of auxiliary draw-off rollers 900, the direction of rotation of which is now reversed, is maintained. As a result of the reversal of the direction of rotation of this pair of auxiliary draw-off rollers 900, the thread 3 is drawn off again from the spinning rotor 11. At the same time, the thread 3 is supplied to the thread suction device 90 which receives the spun thread 3.

In the same way as in the joining draw-off by means of the bobbin 33, here too the thread 3 is released in the joining phase over a very long length. The twists in the thread 3 which are produced by the spinning rotor 11 rotating at full speed can therefore be distributed over a long length, so that the resistance to propagation of the twist to the collecting surface (collecting groove), which is generated as a result of the thread deflection at the mouth of the thread draw-off tube 12 facing the spinning rotor 11, is sufficient for a substantially longer time to prevent excessive twisting in the thread portion located in the spinning rotor 11. Therefore, depending on the amount of the distance between the pair of auxiliary draw-off rollers 900 and the thread draw-off tube 12, a lower or higher speed of the spinning rotor 11 can be selected within specific maximum limits.

The suction nozzle 24 and the deflecting member 99 assume, in relation to the run of the thread drawn off from the spinning rotor 11 by the pair of auxiliary draw-off rollers 900, such a position that the thread portion between the suction nozzle 24 and the deflecting member 99 runs essentially parallel to the thread portion between the thread draw-off tube 12 and the pair of auxiliary draw-off rollers 900. The bobbin 33 is now stopped.

The thread store 98 is then pivoted into the run of the thread drawn off from the thread draw-off tube 12 by the pair of auxiliary draw-off rollers 900. The thread connection device 97 is subsequently brought into the run of the threads 3 and 38. During the time when the thread connection operation is carried out, the two threads 3 and 38 must be stopped in its working region. This is effected by means of the intermediate storage by the thread store 98 of the thread quantity supplied by the spinning rotor 11, whilst the thread 38 is, in any case, not moved because the bobbin 33 is stopped. In the course of the thread connection operation, the two threads extending to the thread suction device 90 and to the suction nozzle 24 are cut off and conveyed away.

After the thread connection operation has been completed, the thread connection device 97 releases the thread which now extends again from the spinning rotor 11 to the bobbin. The bobbin 33 is lowered onto the main drive roller 31 and driven by this again, the thread store 98 gradually emptying again. The deflecting member 99 now also releases the thread again, so that the latter resumes the thread run which is customary for production.

Figure 4:
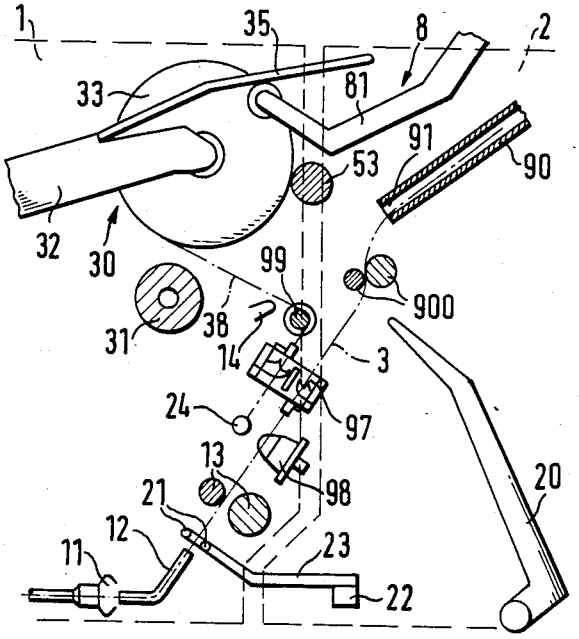

If the device described with reference to FIGS. 3 and 4 is to be used, without the leader being replaced by another type of thread connection, then the cutting device 92 and the thread clamp 95 are not actuated. At the same time as the start of the joining draw-off by the pair of auxiliary draw-off rollers 900 or shortly thereafter, the bobbin 33 is brought up against the main drive roller 31 again, and synchronously in time with this the thread is released from the pair of auxiliary draw-off rollers 900 in a way known per se.

At low working speeds, the draw-off running-up speed can be selected freely; however, at high thread draw-off speeds it is expedient, for the reasons already described, if the running-up curve is matched to the running-up curve of the fiber feed which is effective in the spinning rotor 11.

When a pair of auxiliary draw-off rollers 900 according to FIGS. 3 and 4 is driven, there is no problem in adhering to a specific running-up curve, since the masses of this pair of rollers, which are to be driven, are always constant.

To achieve specific slip ratios during joining draw-off by means of the bobbin 33, it is necessary to provide separate devices for lifting off the bobbin 33 from the main drive roller 31 and for driving the bobbin. It is possible here, in principle, for the bobbin-lifting mechanism 4 to engage on the bobbin arm 32 or on an arm 35 attached to this and at the same time to form the support mechanism 8, that is to say, the bobbin 33 remains with its imaginary axis in a specific lifting-off position during the entire elimination of the thread break. Here also, the position of the pivoting arm 50 of the auxiliary bobbin drive 5 changes according to the bobbin size, so that even here the tension spring 7 generates a varying roller pressing force as a function of the bobbin diameter. However, in such a design, only the radius of the bobbin 33, that is to say half its diameter, acts on the tension spring 7.

When light-barrier monitoring is assigned to the bobbin 33, this can also cause the bobbin 33 to be lifted off in such a way that the distance "a" between the periphery of the bobbin 33 and the periphery of the main drive roller 31 is always the same amount irrespective of the bobbin diameter. In this way, as in the exemplary embodiment described with reference to FIG. 1, the entire diameter of the bobbin 33 can be utilised for changing the spring tension.

Such light-barrier monitoring can also be used when there is a support mechanism 8, but when this does not have separate drive and supporting levers.

When a support mechanism 8 with separate drive and supporting levers (80 and 81) is provided, there is a switching device which, in the embodiment illustrated, is designed as a switch 85. If desired, there can also be instead of this, a switching linkage which causes the drive lever 80 to be uncoupled from the motor 86 and to be fixed (for example, by means of a pawl) in its momentary position. Also, the stops 82 and 83 can either be located on the drive lever 80 or on the supporting lever 81 or can even be divided between the two levers.

The support mechanism 8 does not have to be supported on an additional arm 35 of the bobbin arm 32, but can also engage on this itself or a prolongation of it.

The design of the elastic element assigned to the pivoting arm 50 can also be different from the illustration. Thus, it is entirely possible to provide, instead of a spring, a hydraulic or pneumatic piston. Instead of a tension spring 7, a compression spring can also be used. FIG. 2 shows a further modification of the device, in which there is a torsion spring 70, one leg 71 of which is supported on the pivoting arm 50 and the other leg 72 of which is supported on a bearing 54 receiving the pivot pin 51 of the pivoting arm 50. As shown in FIG. 2, such a design is especially compact.

In the design described, the roller 52 has a cover 53 made of soft rubber or another material. As a result, an enlargement of the bearing surface of the roller 52 on the bobbin 33 is obtained, since the cover 53 endeavours to deflect laterally the bearing pressure acting on it. At the same time, despite a good drive take-up, the roller 52 can even have a smooth surface, so that the material wound on the bobbin 33 is treated carefully in comparison for example, with a roller consisting entirely of metal and provided on the periphery with a grooving or the like, although this is, of course, also possible.

The various elements, such as the suction tube 20, pivoting arm 50 and drive lever 80 or the elements discussed, but not shown, can be driven in various ways, for example by means of pneumatic or hydraulic pistons. The design illustrated, with an adjustable intermediate linkage 64, 65, 66, 67 and 68, is especially advantageous if the motor 60 drives various cam disks 62 via the cam shaft 61, for example for moving the suction tube 20 and/or for pivoting the pair of auxiliary rollers 21 and/or for lifting off the pressure roller from the driven roller of the pair of draw-off rollers 13. In this case, the intermediate linkage 64, 65, 66, 67 and 68 makes it possible, in an especially simple way, to match the individual drives to the working conditions, especially when as identical dimensions as possible are to be provided for the individual parts of this intermediate linkage.

It is possible, furthermore, to provide another direction for the material flow, in which case the working elements must be arranged in a manner different from the drawing and adapted accordingly.

We claim:

1. A device for joining a thread in an open-end spinning device having a bobbin, comprising:

a first pair of auxiliary rollers for receiving, feeding back and releasing the thread on the open-end spinning device;

a pair of draw-off rollers for drawing off the thread during the normal spinning operation;

an auxiliary draw-off device located at a greater distance from said open-end spinning device than the normal draw-off distance whereby the twist arising as threads are joined can be distributed over a greater length of thread to reduce over-twisting;

a thread-cutting device and a feedback-measuring device which are associated with said first pair of auxiliary rollers; and a thread throw-off member for deflecting the thread which is located between said pair of draw-off rollers and the bobbin.

2. A device according to claim 1 further including:

means for receiving spinning rotors of different diameters and means for adjusting said feedback-measuring device as a function of the particular diameter of the spinning rotor received by said receiving means.

3. A process for joining a thread in an open-end spinning device, in which the thread is delivered back to the open-end spinning device by unwinding a bobbin and by rotating a pair of auxiliary rollers in a backward direction and subsequently the thread is again drawn out of the open-end spinning device by reversing the rotation direction of the bobbin and during the process of thread production the thread is held between a pair of draw-off rollers, the thread joining process comprising the steps of:

releasing the thread from the pair of auxiliary rollers after termination of the delivery of the thread back to the open-end spinning device by the pair of auxiliary rollers, and withdrawing the thread exclusively by means of the bobbin in an auxiliary draw-off and placing the thread in a thread run passing between the pair of draw-off rollers.

4. A process according to claim 3 in which the thread withdrawal speed during the auxiliary draw-off step is accelerated synchronously with the rate of fiber feed to the spinning rotor until the thread withdrawal speed associated with normal thread production has been attained.

5. A process for joining a thread in an open-end spinning device having a spinning element, in which process the thread is delivered back to the open-end spinning device through a draw-off tube by unwinding a bobbin and by rotating a pair of auxiliary rollers in a backward direction, is subsequently drawn out of the open-end spinning device by reversing the rotation direction of the bobbin, and is placed in a thread run located between a pair of draw-off rollers after the withdrawal speed associated with normal thread production has been reached, the process including the steps of:

before the feedback of the thread, forming a thread reserve by means of a throw-off member deflecting the thread run a predetermined distance, bringing the thread end to be supplied to the open-end spinning device to a specific length, feeding back the thread end to a position of readiness within the draw-off tube at a distance from the spinning element by means of the pair of auxiliary rollers, releasing the thread by the pair of auxiliary rollers, and carrying out the joining feedback of the thread to the spinning element by throwing-off of the thread by the throw-off member.

6. A process according to claim 5 wherein the specific length of the thread is selected such that the thread end fed to the open-end spinning device while simultaneously building-up the thread reserve, extends to the open-end spinning device, and that only subsequently the thread is brought into its position of readiness within the draw-off tube by further feedback of the thread by means of the bobbin and the pair of auxiliary rollers.

7. A process according to claim 5 wherein the spinning rotor of the open-end spinning device is exchangeable for a spinning rotor with a different diameter, the process further including the step of selecting the position of readiness within the open-end spinning device by means of the pair of auxiliary rollers so that, irrespective of the particular diameter of the spinning rotor selected, the distance of the joining feedback as a result of throwing-off of the thread is always the same distance.

8. A device for joining a thread in an open-end spinning device having a pair of draw-off rollers for withdrawing the thread out of the open-end spinning device, a main bobbin drive roller for driving the bobbin for winding-up the thread, an auxiliary drive roller for the bobbin which may be driven in both directions, and a pair of auxiliary rollers for clamping the thread and having a drive for delivering the thread back to the open-end spinning device, this joining device comprising:

a control means for rotating the bobbin and the pair of auxiliary rollers in a manner such as to deliver the thread back to the open-end spinning device, means for separating the pair of auxiliary rollers when the pair of auxiliary rollers has terminated the backdelivery of the thread, and means for reversing rotation of the bobbin and for rotating the bobbin in the winding direction so as to draw the thread out of the open-end spinning device.

9. A device according to claim 8 further including:

adjustable drive means for the bobbin, said adjustable drive means being adjustable to permit said bobbin to be accelerated to the normal draw-off speed in a relation synchronized with the taking effect of the fiber feed in the spinning rotor.

10. A device according to claim 1, comprising a main bobbin drive for driving the bobbin for winding-up the thread, and an auxiliary drive roller for the bobbin which may be driven in both directions, further including a pressing device associated with said auxiliary drive roller for the bobbin, said pressing device urging the auxiliary drive roller for the bobbin against the bobbin with increasing contact pressure as the diameter of the bobbin increases.

11. A device according to claim 10, wherein a pivoting arm having an elastic element and a pivoting drive is provided for supporting said auxiliary drive roller for the bobbin, which auxiliary drive roller is pressed against the bobbin by said pressing device on the side remote from the bobbin drive roller.

12. A device according to claim 11 wherein said pressing device includes a torsion spring.

13. A device according to claim 11 wherein said elastic element assigned to the pivoting arm is a torsion spring.

14. A device according to claim 13 wherein said pivoting drive for the pivoting arm includes a rotatable cam disk and an adjustable intermediate linkage between the cam disk and said pivoting arm.

15. A device according to claim 14 wherein said auxiliary drive roller for the bobbin carries a cover comprising a soft rubber-like material.

16. A device according to claim 1, comprising a main bobbin drive for driving the bobbin for winding-up the thread, and wherein a lifting element is provided for lifting the bobbin from the main bobbin drive roller such as to form a specific distance between the peripheral faces of the bobbin and the main bobbin drive roller, which distance is always constant.

17. A device according to claim 16, wherein said bobbin is received by bobbin arms, and a support mechanism cooperating with one of said bobbin arms is provided for securing said specific distance between the peripheral faces of the bobbin and the main bobbin drive roller after said bobbin-lifting element has been withdrawn thereby allowing for compensation for varying bobbin mass.

18. A device according to claim 17, wherein, in an open-end spinning machine with a plurality of open-end spinning devices said bobbin-lifting element is arranged to be stationary in each spinning unit and said support mechanism and auxiliary bobbin drive are located on a service mechanism which is movable along the open-end spinning devices.

19. A device according to claim 17 wherein said support mechanism includes a drive lever;

a controllable drive for driving said drive lever;

a supporting lever which is located on said drive lever;

two stops on said drive lever, said supporting lever being pivotable between said stops;

an elastic element;

said supporting lever being stressed in the direction towards said bobbin by said elastic element, and can thereby be brought into a first end position and, when said supporting lever contacts one of the two bobbin arms, said supporting lever is brought into its second end position;

a switching device on said drive lever to control said drive, and when in its second end position said drive lever activating said switch to end the pivoting movement of the drive lever.

20. A device according to claim 19, wherein the controllable drive for said drive lever is an electric motor and the switching device is a switch located on the drive lever which, when actuated, interrupts the supply of current to the motor.

21. A device according to claim 1 including an auxiliary draw-off device comprising a second pair of auxiliary draw-off rollers which are mounted so as to have the capability of being brought into the thread run on the downstream side of said pair of draw-off rollers.

22. A device according to claim 21 including a thread connection device which is mounted so as to have the capability of being brought into the thread run between said pair of draw-off rollers and said second pair of auxiliary draw-off rollers.

23. A device for joining a thread in an open-end spinning device having a bobbin, comprising:

first auxiliary roller means including a pair of auxiliary rollers for selectively receiving, feeding back, and releasing the thread on the open-end spinning device;

draw-off rollers means including a pair of draw-off rollers for drawing off thread during normal spinning operation;

feedback-measuring means and thread-cutting means, operatively associated with said pair of auxiliary rollers, for measuring a length of thread fed back and cutting same, respectively; and thread throw-off means for selectively deflecting thread which is located between said pair of draw-off rollers and said bobbin;

wherein thread is re-joined by selectively feeding back thread from said bobbin, by function of said auxiliary roller means, in a length determined and cut by said feedback-measuring and said thread-cutting means, respectively, such cut thread being directed to said auxiliary roller means by said throw-off means.

24. A device as in claim 23, further including a control device for providing that a predeterminable time lapse exists between the start of drawing off for rejoined thread and thread reserve utilization.

25. A device as in claim 23, further comprising: a draw-off pipe associated with a spinning rotor; and wherein said pair of draw-off rollers include a pressure roller and a driven roller; and wherein said pressure rollers is lifted off said driven roller before thread is re-joined, and thread having been measured off is presented to said draw-off pipe along an arcuate course over said driven roller, and said pressure roller is applied again during start-up of normal spinning draw-off, when said bobbin is powered up to a defined full bobbin speed.

26. A device as in claim 25, wherein said pressure roller is adapted to be controlled from a service device which is movable alongside a plurality of open-end spinning stations associated with said device.

27. A device as in claim 23, further comprising:

a pressure roller and a driven roller to constitute said draw-off rollers;

a main drive for said bobbin;

means for selectively lifting said pressure roller from said driven roller, releasing said bobbin from said main drive, subsequently drawing off thread from said bobbin while the rotation of said bobbin is reversed, leading said thread over said thread throw-off means and bringing same to a defined length, cutting said thread, bringing the cut thread end before said thread draw-off pipe, feeding same between said driven roller and said pressure roller forming said pair of draw-off rollers, and subsequently feeding same back into a position of readiness defined as a position of said thread in said thread draw-off pipe;

whereupon said thread throw-off means throws off said thread which is then fed upon a fiber collecting surface by negative air pressure existing within said device, whereby newly spun thread is then drawn off from such fiber collecting surface at increasing speed and whereby said bobbin, upon reaching a defined full bobbin speed, is lowered upon said main drive, and said pressure roller is again brought to bear upon said driven roller;

whereby thread breaks are automatically and reliably re-joined by said device.

28. A device as in claim 27, wherein said pressure roller is adapted to be controlled by a service device which is movable alongside a plurality of said open-end spinning devices, whereby said pressure roller can thereby be selectively lifted upon from said driven draw-off roller and subsequently and controllably be reapplied upon said driven draw-off roller.

* * * * *